US006474933B1

(12) United States Patent
Hoechst et al.

(10) Patent No.: US 6,474,933 B1
(45) **Date of Patent: *Nov. 5, 2002**

(54) EXTENDED REACH VERTICAL LIFT BOOM

(75) Inventors: Lonnie D. Hoechst, Gwinner; Charles H. Krause, Hankinson, both of ND (US)

(73) Assignee: Clark Equipment Company, Woodcliff Lake, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 768 days.

(21) Appl. No.: 08/914,199

(22) Filed: Aug. 18, 1997

Related U.S. Application Data

(63) Continuation of application No. 08/816,130, filed on Mar. 12, 1997, now abandoned, which is a continuation of application No. 08/472,326, filed on Jun. 7, 1995, now abandoned.

(51) Int. Cl.[7] ..... E02F 1/00
(52) U.S. Cl. ..... 414/815; 414/686
(58) Field of Search ..... 414/685, 686, 414/697, 700, 708, 786, 815

(56) References Cited

U.S. PATENT DOCUMENTS

| | | | | |
|---|---|---|---|---|
| 1,371,344 A | | 3/1921 | Brackett | 414/685 |
| 2,455,474 A | | 12/1948 | Drott et al. | |
| 2,518,096 A | | 8/1950 | Thorne | 241/131 |
| 2,538,000 A | | 1/1951 | Hoar et al. | |
| 2,698,106 A | | 12/1954 | McIlhinney et al. | |
| 2,849,132 A | | 8/1958 | Clarke | |
| 2,980,271 A | | 4/1961 | Ulinski | |
| 3,001,654 A | | 9/1961 | Albert | |
| 3,209,930 A | | 10/1965 | Derruppe | |
| 3,215,292 A | | 11/1965 | Halls | |
| 3,352,441 A | | 11/1967 | Alden | |
| 3,411,647 A | | 11/1968 | Zimmerman | |
| 3,491,906 A | | 1/1970 | Davidson | |
| 3,522,898 A | | 8/1970 | Rotheisler | |
| 3,586,195 A | | 6/1971 | Beltrami | |
| 3,658,202 A | | 4/1972 | Peterson | |
| 3,802,589 A | | 4/1974 | Holtkamp | |
| 3,910,440 A | | 10/1975 | Holtkamp et al. | |
| 4,162,873 A | | 7/1979 | Smith, Jr. | |
| 4,355,946 A | | 10/1982 | Wykhuis et al. | 414/707 |
| 4,388,038 A | | 6/1983 | Freitag | 414/685 |
| 4,427,334 A | | 1/1984 | Copie et al. | 414/710 |
| 4,699,560 A | | 10/1987 | Ostermeyer et al. | 414/696 |
| 5,106,257 A | * | 4/1992 | Braud et al. | 414/700 X |
| 5,169,278 A | | 12/1992 | Hoechst et al. | 414/685 |
| 5,184,932 A | | 2/1993 | Misuda et al. | 414/685 |
| 5,405,237 A | | 4/1995 | Oka | 414/685 |
| 5,470,190 A | | 11/1995 | Bamford et al. | 414/686 |
| 5,511,932 A | | 4/1996 | Todd et al. | 414/685 |
| 5,542,814 A | * | 8/1996 | Ashcroft et al. | 414/786 |
| 5,609,464 A | | 3/1997 | Moffitt et al. | 414/685 |
| 5,860,233 A | | 1/1999 | Roubinet | 37/466 |

OTHER PUBLICATIONS

Title page, table of contents and pp. 727–777 from book entitled "Mechanisms, Linkages and Mechanical Controls", edited by Nicholas P. Chironis (McGraw–Hill 1965).
Model 345 Mustang Loader Brochure, Mar., 1982.
Model 445 Mustang Loader Brochure, Jan., 1980.
Model 545 Mustang Loader Brochure, Aug., 1980.

* cited by examiner

*Primary Examiner*—Donald W. Underwood
(74) *Attorney, Agent, or Firm*—Westman, Champlin & Kelly, P.A.

(57) ABSTRACT

A boom assembly has articulated boom section which permit a lifting bucket or working tool to a raised position in which the boom end moves substantially vertically for a selected portion of its movement of the boom above which the boom end moves upwardly and forwardly. The links are used are selected in length to permit this travel. The links are supported close to the loader support axles to transfer loads to the ground through a short load path.

6 Claims, 3 Drawing Sheets

EXTENDED REACH VERTICAL LIFT BOOM

This is a continuation of application Ser. No. 08/816,130, filed Mar. 12, 1997, now abandoned which is a continuation of Ser. No. 08/472,326, filed Jun. 7, 1995, now abandoned. Priority of the prior applications is claimed pursuant to 35 USC § 120.

BACKGROUND OF THE INVENTION

The present invention relates to a linkage assembly for use with a boom of a skid steer loader that controls the path of the pivot attachment point between the boom and a bucket or other implement to permit reaching a greater height and providing for a substantially vertical path for the lower portion of boom travel and a forward movement of the attachment point relative to the loader frame in the upper portions of the path of travel of the boom.

The U.S. Pat. No. 5,169,278 discloses a vertical lift loader boom that has a control linkage that guides movement of the outer end of the boom as it is raised and lowered. The control linkage is arranged to provide a generally vertical path of movement, and fits onto existing loader frames.

The present invention provides for a linkage that ensures a high lift with a forward movement of the bucket, particularly in the upper one-third of the path of movement, and with the maximum forward movement at or near the maximum height of the boom.

SUMMARY OF THE INVENTION

The present invention relates to a loader boom system that has a control linkage that includes selected lengths and arrangement of the control links so that as a hydraulic actuator moves the boom upwardly, the forward end of the boom, where the boom attaches to a bucket or other tool, moves substantially vertically and slightly forwardly until the boom reaches in the range of the upper one-third of its travel. Then, the outer end of the boom moves forwardly in order to reach a location that is being used for dumping. The boom has a main boom portion, that is pivoted to boom supports on the loader structure through an articulated boom support link that is elongated in vertical direction. A control link is attached at one end to the boom at a desired location, and attached to the loader frame or boom support frame adjacent to the axle point of the loader at an opposite end. The control link is elongated, to provide for control of the advanced boom path, as the boom is lifted, the control link causes the articulated boom support link to pivot substantially rearwardly as the boom is initially raised, and then incline forwardly, with maximum forward inclination at the uppermost travel of the boom.

The disclosed linkage arrangement provides the ability to raise a load and move it forwardly relative to loader frame at the upper portion of boom operation to increase the ease of loading, and yet. have a substantially vertical path in the lower two-thirds or so of its path.

DETAILED DESCRIPTION OF THE PREFERRED EMBODIMENTS

Figure 1:
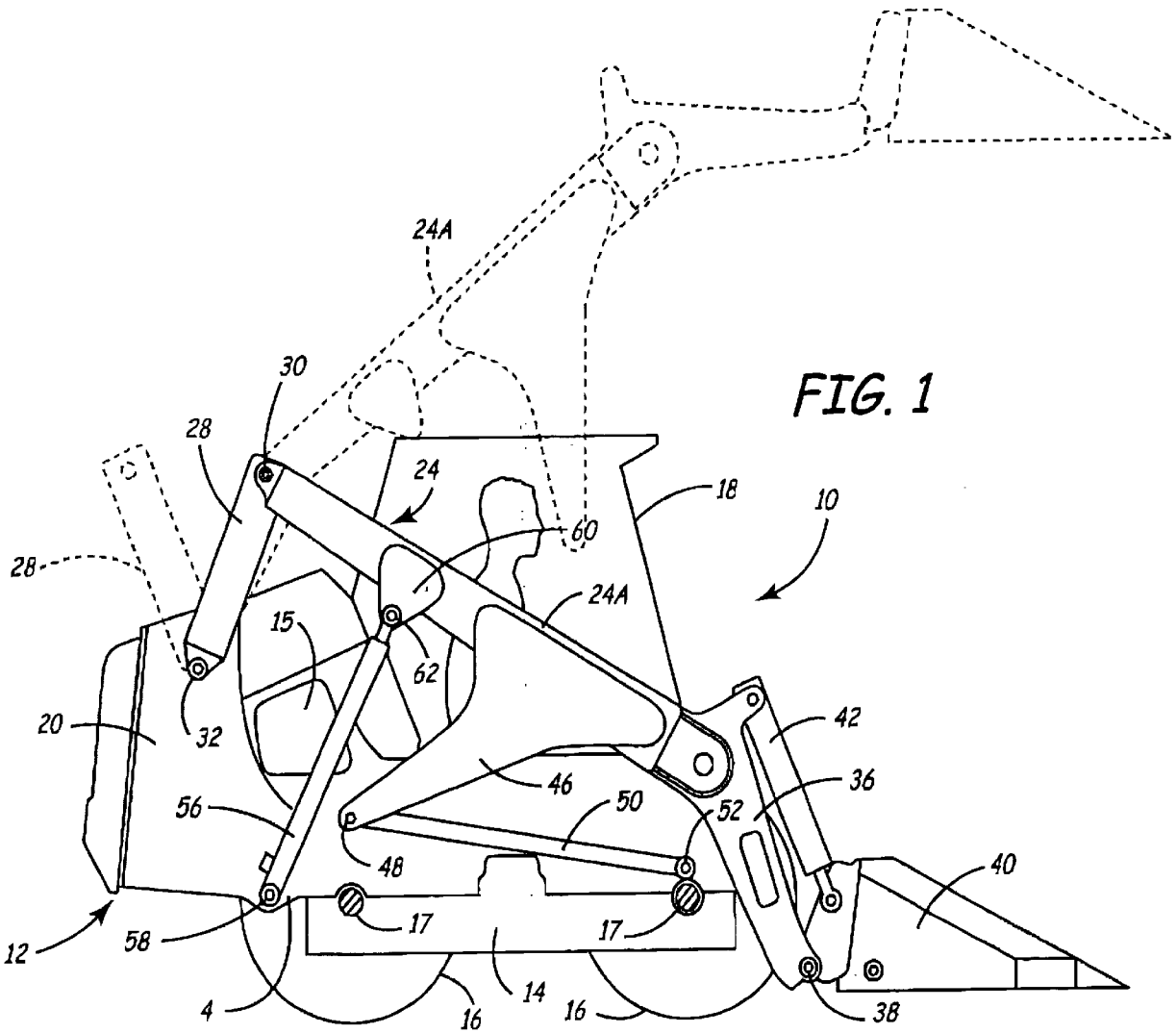
FIG. 1 is a side elevational view of a skid steer loader having a loader boom installed thereon utilizing linkages made according to the present invention.

The present invention is shown in simplified illustration of a skid steer loader assembly, and it is to be understood that the skid steer loader has four wheels, a power source, and that the linkage that is shown on this side of the frame will have a mirror image linkage on the opposite side of the frame. The boom assembly normally has a pair of parallel booms, one on each side of an operator's cab as generally shown in FIG. 4 of U.S. Pat. No. 5,169,278. The wheels of the loader frame on the near side in the figures of this application have been removed for clarity.

Referring specifically to the loader assembly, indicated generally at 10, it includes a skid steer loader or prime mover 12 that has a transmission housing 14 that extends longitudinally in fore and aft directions. The main frame 4 is supported on the transmission and thus is supported on front and rear wheels 16, driven in a suitable manner through a drive train to drive axles 17. An engine in engine compartment 15 is used for powering the loader and is mounted rearwardly of an operator's compartment 18. A pair of frame uprights 20 (one side is shown) are at the rear portion of the main frame 4 and are used for supporting a boom assembly 24. The boom assembly 24 is made up of a pair of spaced apart boom members 24A, with one member on each side of the loader. The boom assembly 24 includes an articulated boom support link 28 on each side of the loader. The link 28 on opposite sides of the loader are joined with suitable cross-members as shown in U.S. Pat. No. 5,169,278.

The main boom section 24A is pivotally mounted as at 30 with suitable pivot pins to an outer or upper end of the boom support link 28, and the lower end of the boom support link 28 is pivotally mounted as at 32 to the frame upright or boom support 20. The forward end of the main boom section 24A has a forward end section 36 which has a forward pivot connection 38. This connection is used for pivotally mounting a bucket 40 or other tool or implement to the boom. A hydraulic cylinder 42 is used for controlling the position of the bucket 40 about the pivot 38 in a normal manner.

The main boom section 24A of the boom assembly 24 has a boom arm 46 extending downwardly and rearwardly from the main boom section, and the arm 46 has an outer end pivot point 48 that is, with the boom in its lowered position, substantially below the pivot point 32 for the boom support link 28. The pivot 32 is substantially directly above the rear axle 17 and is kept as close to the rear axle as reasonable. Pivot point 48 is used for connecting a first end of a control link 50 to the arm 46. The control link 50 has its second end pivotally mounted as at 52 to the transmission housing 14. The pivot 52 is almost directly above, and very close to the front axle 17.

Pivotal movement of the boom assembly, in particular the main boom section 24A, in an up and down direction is controlled by a hydraulic cylinder 56 on each side of the loader. The cylinder 56 is pivotally mounted as at 58 to the rear of and substantially on the same level as the center line of the axis for rear axle 17. A frame section 4 supports the pivot 58. The cylinder 56 extends upwardly and has a rod attached to a plate 60 that is fixedly attached to the main boom section 24A. The rod end of cylinder 56 is connected at a pivot 62 to the plate 60.

Figure 2:
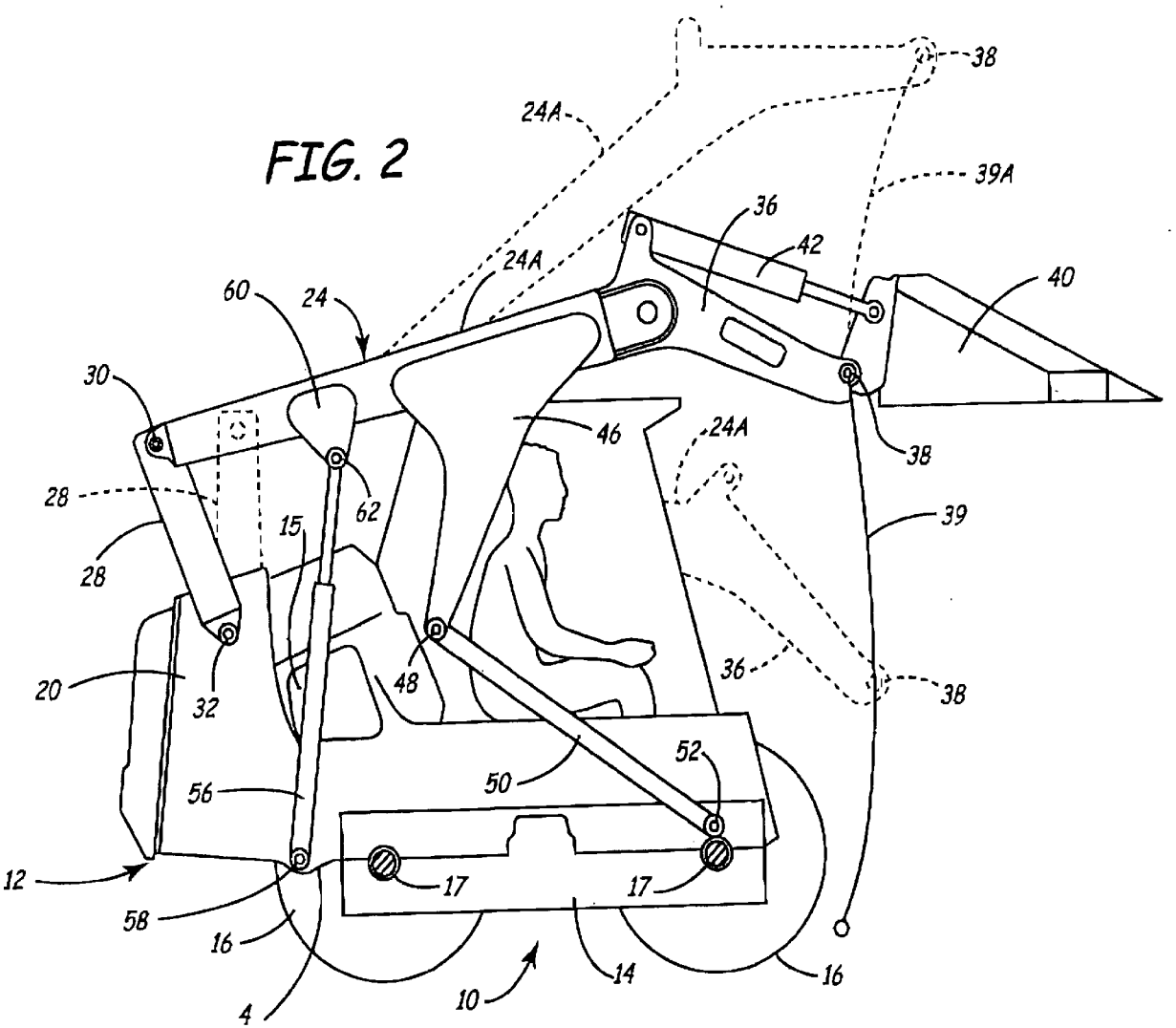
FIG. 2 is a side elevational view of the device at FIG. 1 with the boom at approximately a ⅔ raised position, and with an articulated boom support link at a maximum rearward position.

As can be seen the forward pivot of control link 50 is moved to be very close to the vertical height of the axle 17, and this permits the perpendicular distance,of,pivot 48 from a line between pivots 30 and 38 to be relatively long. Furthers the moving of the hydraulic cylinder attachment pivot 58 to a position low down and to the rear of the axle 17 permits increasing the length of the hydraulic cylinder 56 so that the overall available cylinder extension is increased. The boom support link 28 is also positioned in a unique location and can be increased in length from that shown in U.S. Pat. No. 5,169,278. The overall length of boom support link 28, and the length of control link 50, as well as the positioning of the pivot 48, is such that the boom support link 28 immediately starts to move rearwardly as pivot 38 is lifted by extending the cylinder 56 from its lowered portion. The upper end of boom support link 28 continues to move rearwardly, and at about one half of the vertical travel of the boom the boom support link is substantially vertical. As the boom is raised further, the boom support link continues to pivot rearwardly until the boom is in position as shown in FIG. 2, where the boom support link 28 is in its maximum rearward position. The path of the pivot 38, and thus the loader bucket is substantially vertical and actually moves forwardly slightly as shown by the path section 39 represented in FIG. 2.

Continued raising of the boom assembly 24 causes the control link 50 to start to move the boom assembly 24 forwardly, and the boom support link 28 starts to pivot forwardly. For the last portion of travel between the positions in FIGS. 2 and 3, the boom support link 28 moves forwardly to cause the pivot 38, and thus bucket 40 or other tool attached thereto, to move forwardly as well during this last position of the upward movement.

Thus, the arrangement of the linkage causes the boom assembly to move substantially vertically and slightly forwardly during at least the first one-half of its upward travel. Subsequently the boom assembly starts to move forwardly in a pronounced manner to move the pivot 38 forward and toward a location for dumping a load by the bucket 40 or other tool, as shown at 39A.

The boom arm 46 for link 50 is configured so that at the maximum upward travel the link 50 is close to being on center, and thus at its maximum full position. Likewise, the boom support link 28 becomes close to on center with the pivot 62, so the boom support link 28 is at its substantial maximum forward travel, as well as having the boom section 24A at its maximum upward position. The pivot 32 is relatively close to a vertical plane passing through the axis of rear axle 17, and is relatively close to a horizontal plane passing through the axis of rear axle 17 as well.

Figure 3:
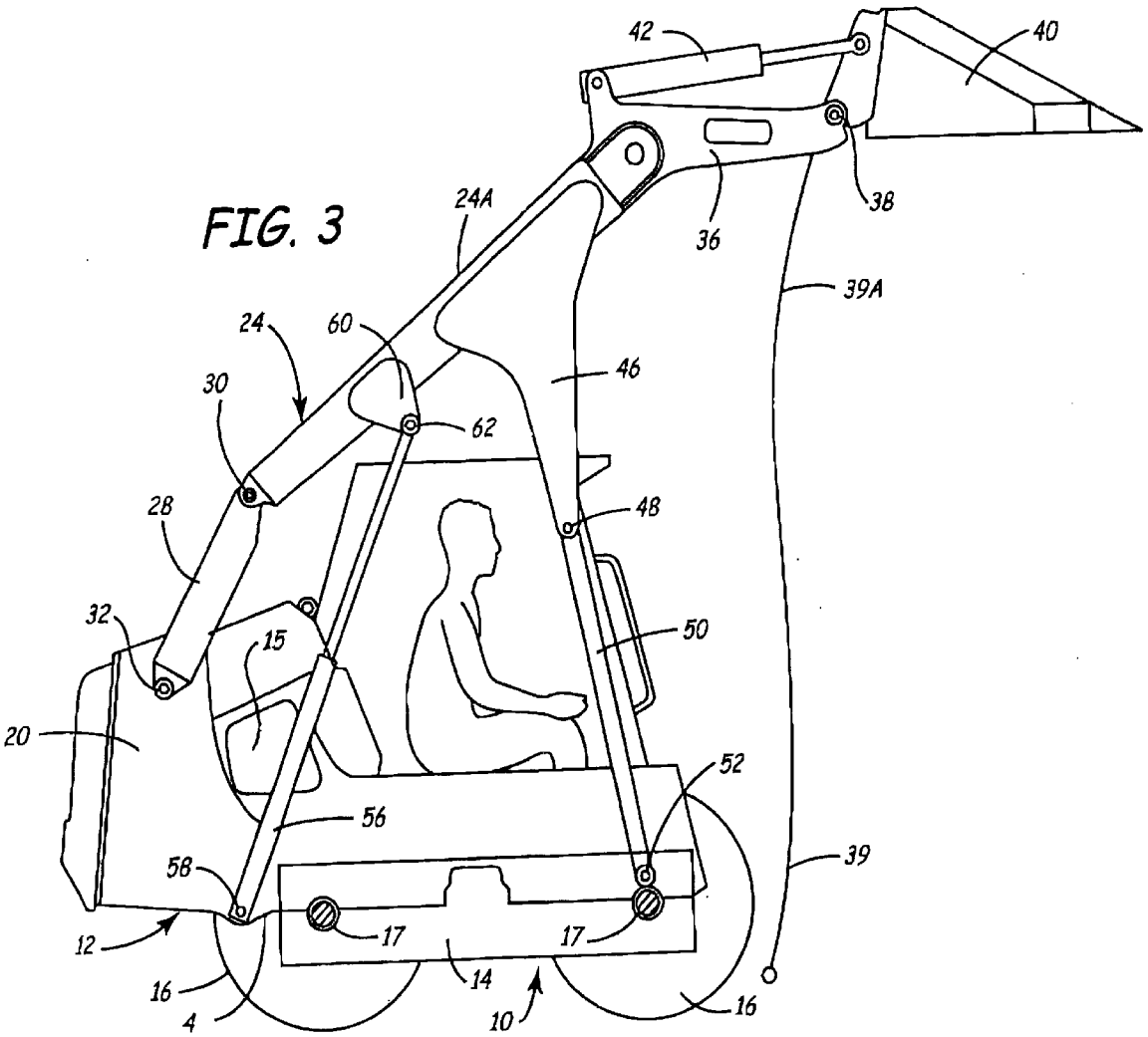
FIG. 3 is a side elevational view of the device at FIG. 1 with the boom in a uppermost position.

It should be noted that the boom link 28 reaches its maximum forward pivoting movement at the maximum height position of the boom as shown in FIG. 3. This portion of boom support link 28 is represented in dotted lines in FIG. 1 as well to illustrate that the link is pivoted farther forward than its solid line position shown in FIG. 1 which shows the boom in the lowered position.

By moving the pivots of the link 50 and the hydraulic cylinder 56 closer to the axles 17, they can be made longer and can provide for a longer path of movement of the boom. The rear pivot of link 50 is substantially directly vertically above the rear axle 17, and it is much closer to the axle than in previous designs. The number of structural components between the points of attachment of the boom to the loader frame and the wheel attachment point to the loader frame is reduced. The structure between these points ultimately transfers the boom loads to the ground, and the shorter load bearing paths simplifies and reduces the costs in the overall load and carrying structure.

The linkage attachment at pivots 58 and 52 in particular and also at 32 are low in relation to the axle 17 as opposed to previous boom supports for skid steer loaders.

What is claimed is:

1. A method of moving a material handling tool in a lift path using a skid steer prime mover having a longitudinally extending frame with supports fixedly attached to the frame and extending upwardly from the frame;

a boom assembly including a main boom section having arm members on each side of the prime mover with a linkage for supporting a rear end of the main boom section relative to the supports on the frame, the linkage including a fixed length link on each side of the prime mover pivoted to upper ends of the supports and to the main boom section on fixed position axes and inclining upwardly and forwardly from the supports to the pivot of the fixed length link to the main boom section with the main boom section lowered, and a material handling tool that is to be raised and lowered attached to a forward end of the main boom section;

a hydraulic actuator for pivoting the main boom section to raise and lower the forward end of the main boom section and the material handling tool for moving said tool along the lift path, including the steps of:

pivotally connecting a control link to the main boom section, and to the frame on fixed position axes and guiding and moving said tool from a known position, as said tool is initially moved upwardly along its lift path in a substantially vertical direction to an intermediate position in its lift path while causing movement of the fixed length links rearwardly about their Divots to the supports to a rearward pivoted position; and subsequently moving said tool upwardly from said intermediate position along a path that continually moves forwardly by controlling the fixed length links to move forwardly by positioning the pivots and selecting the length of the control link to complete the lift path at a final position where the tool is forward of said intermediate positions thereby forming an S-shaped lift path between the known position and the final position.

2. The method of claim 1 including the step of positioning said tool at a location forwardly of the longitudinal frame in close proximity to ground at its known position.

3. A method of operating a skid steer loader having a frame:

the frame being supported for movement along the ground on a pair of axles on a lower side of the frame supporting ground engaging wheels;

a pair of boom supports on the frame at a rear end thereof and extending upwardly above the wheels;

a boom assembly including a main boom section comprising a pair of main boom members and a boom support link comprising a single pair of parallel link arms pivotally mounted to the boom supports on the frame at a location above a top plane of the wheels and pivotally mounted to the main boom members so the link arms form a single boom support link of fixed length between fixed position pivots, said main boom section having a forward end tool pivot for attachment to a tool that is to be raised and lowered;

a hydraulic actuator for raising and lowering the forward end of the main boom section about the pivot connections to the boom support link, the method comprising moving the forward end tool pivot in a lift path by:

providing a fixed length control link pivoted on the frame at one end and on the boom assembly at the other end for guiding pivotal movement of the single pair of parallel link arms, the boom assembly and the forward end tool pivot;

operating the hydraulic actuator to move the forward end tool pivot from a lowered position to a raised position by first moving the tool pivot upwardly while guiding the movement with the control link to move the forward end tool pivot forwardly and then substantially vertically up to a selected vertical position of the lift path while moving the single pair of parallel link arms about the pivot of the link arms to the boom supports and initially moving the pivot between the link arms and the main boom members rearwardly; and thereafter moving the tool pivot forwardly by guiding the single pair of link arms so the pivot between the single pair of link arms and the main boom members moves forwardly as the tool pivot is moved toward a raised position until the tool pivot reaches a maximum forward position at its raised position thereby defining an S-shaped lift path.

4. A method of moving an end of a loader boom in a lift path using a skid steer loader having a frame with support wheels and boom supports fixedly attached to the frame and extending upwardly to a level above the level of the support wheels;

a boom assembly including a main boom section having arm members on each side of the skid steer loader with a fixed length link for pivotally supporting a rear end of the main boom section on a first pivot and the fixed length link being pivoted to the boom supports on a second fixed location pivot at a level above the support wheels with the first and second pivots being the sole pivots on the fixed length link, and a connection for a material handling tool that is to be raised and lowered at a forward end of the main boom section;

a hydraulic actuator for pivoting the main boom section to raise and lower the forward end of the main boom section through a generally vertical path for moving the connection along the lift path, including the steps of:

initially moving said tool from a known position in a substantially vertical direction, while the lift path first moves forwardly of the known position and substantially vertically to an intermediate position in its lift path while causing the first pivot between the fixed length link and the rear end of the main boom section to move rearwardly; and subsequently moving said tool upwardly and causing the first pivot of the fixed length link to move forwardly so the tool moves continuously forwardly from the intermediate position to complete the lift path at a final position where the tool is forward of said intermediate position and the lift path is generally S-shaped between the known and final positions, while moving the first Divot of the fixed length link forwardly of the position of the first divot of the fixed length link at the intermediate position of the tool.

5. The method of claim 4 including the step of placing the intermediate position forwardly of the known position.

6. A method of moving a material handling tool in a lift path using a wheel supported skid steer loader frame with a forward end and rear end and with boom support means fixedly attached to the rear end of the frame and extending upwardly from the frame;

a boom assembly including a main boom section having arm members on each side of the prime mover with a fixed length pivot linkage for supporting a rear end of the main boom section about a first linkage pivot, and the linkage being pivoted to the boom support means on the frame about a second linkage pivot, and a material handling tool that is to be raised and lowered attached to a forward end of the main boom section;

a hydraulic actuator for pivoting the main boom section about the first linkage pivot to raise and lower the forward end of the main boom section and the material handling tool through a generally vertical lift path for moving said tool along the lift path, including the steps of:

initially moving said tool from a known position in a substantially vertical direction to an intermediate position in its lift path while guiding the fixed length linkage with a fixed length control link pivotally mounted at a first end to the frame on a fixed position first control pivot adjacent a forward end of the frame and to the boom assembly on a fixed position second control pivot rearwardly of the first end of the control link, while pivoting the fixed length linkage about the second linkage pivot in an arc from a forwardly inclined position with the tool at a lowered position, so the first linkage pivot moves rearwardly of a vertical plane passing through the second linkage pivot; and subsequently moving said tool upwardly from said intermediate position while guiding the linkage with the control link so the tool moves along a path that continually moves forwardly to complete the lift path at a final position where the tool is forward of said intermediate position, including pivoting the linkage about the second linkage pivot so the first linkage pivot moves forwardly of the vertical plane and to a forward linkage position while moving the tool to its maximum forward position at an upper limit of upward movement of the main boom section.

* * * * *